US005103753A

United States Patent [19]

Aralt

[11] Patent Number: 5,103,753

[45] Date of Patent: Apr. 14, 1992

[54] ARRANGEMENT IN INTERIORS OF SHIPS

[75] Inventor: Per T. Aralt, Hop, Norway

[73] Assignee: Kristian Gerhard Jebsen Skipsrederi A/S, Fyllingsdalen, Norway

[21] Appl. No.: 623,752

[22] PCT Filed: Apr. 20, 1990

[86] PCT No.: PCT/NO90/00070

§ 371 Date: Jan. 7, 1991

§ 102(e) Date: Jul. 1, 1991

[87] PCT Pub. No.: WO90/12728

PCT Pub. Date: Nov. 1, 1990

[30] Foreign Application Priority Data

Apr. 26, 1989 [NO] Norway ..... 891721

[51] Int. Cl.[5] ..... B63B 3/00; B63B 11/02

[52] U.S. Cl. ..... 114/65 R; 114/72

[58] Field of Search ..... 114/65 R, 72, 73, 74 R, 114/116

[56] References Cited

U.S. PATENT DOCUMENTS 3,434,445 3/1969 Crumley ..... 114/72

FOREIGN PATENT DOCUMENTS 3795 1/1979 Japan ..... 114/73

*Primary Examiner*—Sherman D. Basinger

*Attorney, Agent, or Firm*—Francis C. Hand

[57] ABSTRACT

A cargo ship is provided with transverse bulkheads to separate holds from each other. In addition, the bulkheads are arranged in pairs to define compartments therebetween in which flights of steps are arranged. Access openings are also provided in the transversely extending bulkheads to provide access to the steps at various levels. Each flight of steps is contained between two partitions which form a passage within the compartment. A hatch cover is provided at the top to gain access to the passage.

4 Claims, 1 Drawing Sheet

ARRANGEMENT IN INTERIORS OF SHIPS

The present invention relates to an arrangement in interiors of ships, such as general cargo ships, where holds following fore-and-aft are equipped with opposite end bulkheads extending transversely and where end bulk-heads of each pair of fore-and-aft following holds form pairs of transversely extending partition bulkheads having an intermediate compartment and with access from the compartment to adjacent holds.

For safety, for example cargo anchoring and cargo stability reasons, it is important for the ship's crew to be able to gain access in a ready manner to different levels of each hold immediately a need arises for this. Correspondingly it is important for crew reasons to furnish extra evacuation routes in difficult situations. Furthermore, it is of decisive importance for freight and ship, that both the end bulkheads and the partition bulkheads, which define the fore-and-aft following holds relative to each other, can guarantee a desired effective sealing of the holds individually and mutually between the holds. On a possible leakage to a hold on the one side of an end bulkhead or a partition bulkhead, one must be able to ensure that the leakage will not be transmitted to adjacent spaces, for one thing to the compartment between the partition bulkheads or to the hold or the holds on the other side of the remaining partition bulkhead relative to the compartment. It is therefore necessary to have effective sealing arrangements in connection with each access opening in the end bulkhead or partition bulkhead.

With a common passage via the intermediate compartment to the holds on opposite sides of the compartment, it is necessary to have particularly extensive sealing arrangements in connection with each access opening. Further, it is necessary to have extensive procedures in order to guarantee sealing each time the access openings are to be used. Certain problems are presented in practice to carry out such extensive procedures and to furnish suitable sealing arrangements for the various access openings, so that the openings can be opened and closed in a relatively simple manner as required and at the same time sealing ensured on a possible leakage, also on the occurrence of large fluid pressures. Specifically, when a ready access passage is to be provided from the compartment between two partition bulkheads to each of the respective fore-and-aft adjacent holds via the adjacent partition bulkheads, it is particularly necessary to have important safety measures, so that through openings are not formed simultaneously through both partition bulk-heads.

Hitherto steep ladders have been employed to a great extent as the possibility for access to the various access openings. From the ladders, it has been difficult to open and close the access openings in a satisfactory manner. In order to obtain a satisfactory degree of safety, a small number of access openings have been employed in practice from each compartment to each of the adjacent holds.

Accordingly, it is an object of the invention to employ an arbitrary number of access openings to each hold with a cargo ship without the use of complicated sealing arrangements or with moderate demands for using sealing arrangements in connection with the access openings and with minimal need for safety measures in connection with opening and closing of the access openings.

Briefly, the invention is directed to a cargo ship having a plurality of holds which are spaced apart by pairs of partition bulkheads wherein each pair of transversely extending bulkheads defines a compartment therebetween while separating a pair of holds from each other. In addition, one end bulkhead of each hold and preferably both end bulkheads or partition bulkheads on the side facing away from the hold, is/are provided with a flight of steps with connection to the hold via associated landings and access openings at respective levels above each other.

By this there is firstly the possibility of providing easy access to the respective hold via an arbitrary number of access openings with ready opening and closing of the access openings and with reliable sealing of the access openings each time there are used.

The arrangement according to the invention is further characterised in that the compartment between the partition bulkheads between each pair of holds is divided, by means of a heightwise and fore-and-aft extending partition bulkhead, into two separate compartment portions, which have their respective mutually separated access passages each to its of their hold(s) on a respective side of the pair of partition bulkheads.

In certain instances, two or more holds can be employed transversely by the side of each other, while in other instances such as in the preferred embodiment which is shown herein, there are employed connected holds over the whole breadth of the ship, but separated fore-and-aft by said partition bulkheads.

By means of the mutually separated access passages, which are separated from each other by a common, fore-and-aft extending partition bulkhead, there is the possibility of maintaining the access openings of the two access passages permanently separated relative to each other in a simple and ready manner, so that the opening and closing of the single access opening must not necessarily be subjected to strict work routines and must not necessarily have imposed strict requirements for sealing.

Arrangements according to the invention are further characterised in that the flights of steps are defined between an upper and a lower partition bulkhead to form obliquely extending, shaft-forming access passages in the transverse direction of the ship, and that the flights of steps extend parallel to each other each on its respective side of a common, central partition bulkhead.

By this there can be obtained with the aid of simple means a constructionally simple and operatively reliable solution. At the same time effective access passages can be obtained with simple means, which demand little space and which have relatively low volume, and nevertheless provide the possibility for easy access to generally arbitrary levels in the holds.

Further features of the invention will be evident from the following description having regard to the accompanying drawing, in which.

Figure 1:
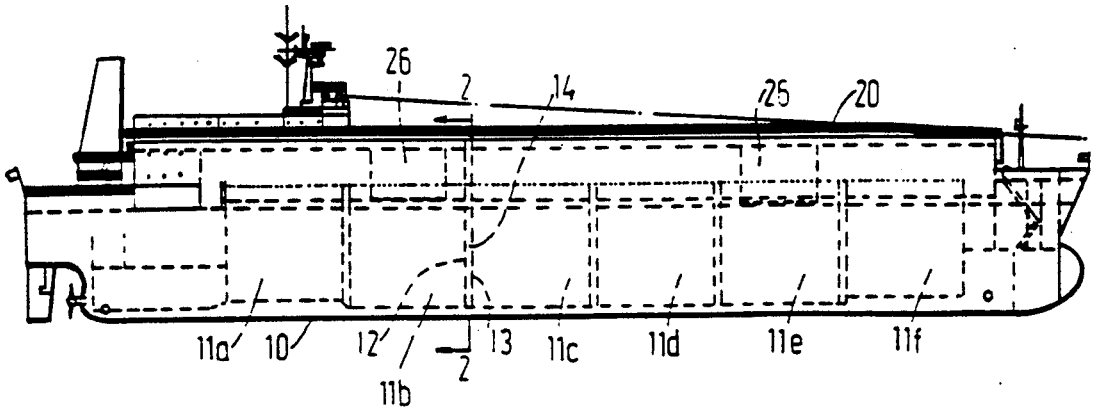
FIG. 1 shows, a side elevation of a general cargo ship according to the invention.

In FIG. 1 there is illustrated a general cargo ship 10 having six mutually separated holds **11*a*–11*f* following fore-and-aft. Each hold is provided with two opposite, transverse end bulkheads 12,13. Between each pair of holds there are erected two transverse extending end bulkheads or partition bulkheads 12,13 with an intermediate partition-forming compartment 14. Each hold is provided with a hatch opening 15 which stretches fore-and-aft from the one end bulkhead 12 to the other end bulkhead 13 and transversely from side bulkhead 16 to side bulkhead 17 which are arranged a distance within a respective ship's side 18 and 19. The compartment 14 stretches correspondingly from side bulkhead 16 to side bulkhead 17 and over the whole height of the hold. Above the holds are covered by an upper deck 20 which on the under side carries transport means 21–25 for conveying freight in the fore-and-aft direction, in the transverse direction and in the height direction internally of the ship together with between the inner side of the ship and the outer side of the ship via upper side port openings 26. Below the bottom 27 of the holds and the bottom side 28 of the ship there is shown a bottom space 29**.

Figure 2:
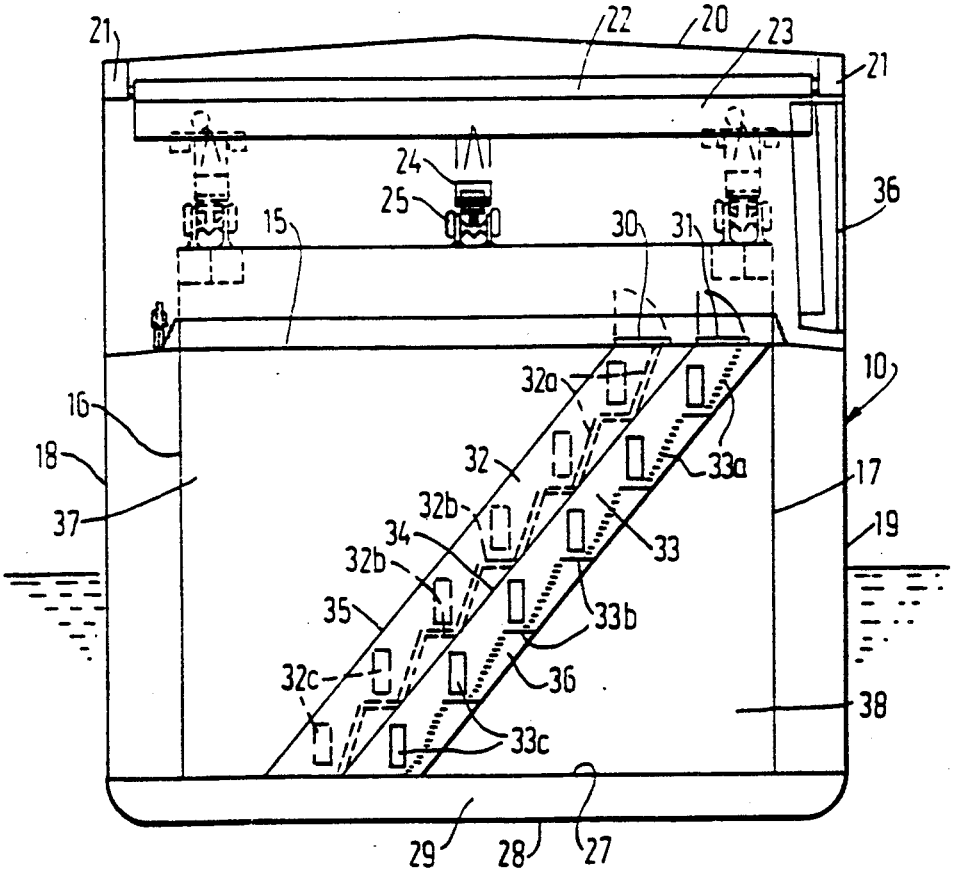
FIG. 2 shows in a cross-section along the line 2—2 of FIG. 1, mutually separated access passages via a common, intermediate compartment to fore-and-aft following holds.

The compartment 14, which is defined between two mutually parallel, transversely extending end bulkheads or partition bulkheads 12,13 and which forms a boundary between two fore-and-aft following holds, is as shown in FIG. 2, provided above with a pair of pivotable access hatches 30,31 to their respective separate access passages 32 and 33 extending shaft-like obliquely downwards. Each of the access passages 32,33 is defined between the transversely extending end bulkheads 12,13 and an intermediate, fore-and-aft extending, common bulkhead 34 together with their respective additional, intermediate, fore-and-aft extending bulkheads 35 and 36. The bulkheads 34–36 run parallel to each other, so that oblique downwardly extending, mutually separated access passages 32,33 are formed from their respective upper access hatches 30,31 to the bottom of the passage. In each access passage, a separate flight of steps 32*a* and 33*a* is arranged each provided with a row of landings 32*b* and 33*b* and with a row of associated access openings 32*c* and 33*c* from each of their respective landings to each of their respective holds, which only communicate with their respective associated access passage and not with the remaining access passage.

By means of the common bulkhead 34 there is provided an effective partition between the access passages 32,33 and their respective holds, so that the individual access passage can form a part of a closed unit together with the associated hold.

By means of the two remaining bulkheads 35 and 36 the access passages can be defined in a manner requiring little space relative to the remainder of the compartment, such as illustrated by the compartment portions 37,38.

Without being illustrated specifically herein flights of steps with associated landings and access openings are also designed on the end bulkheads which define endwise the row of holds and which do not border on an adjacent hold.

In the preferred embodiment according to the invention each end bulkhead or each partition bulkhead is provided with its respective row of access openings connected to its respective flight of steps. By this provision is made for the possibilities of access at opposite ends of each hold, with the possibility for access and evacuation, via an arbitrary number of access openings.

Alternatively, where the conditions dictate, the possibility of access can only be employed at the one end of each hold. In such a case the possibilities of access can be concentrated via only certain of the compartments between the holds impacting in pairs.

I claim:

1. A cargo ship comprising a pair of transversely extending bulkheads defining a compartment therebetween and separating a pair of holds from each other;

a longitudinally extending bulkhead between said transversely extending bulkheads to subdivide said compartment into a pair of sub-compartments;

a flight of steps in one of said sub-compartments, said flight having vertically spaced apart landings at intermediate levels thereof; and a row of access openings in one of said transversely extending bulkheads, each said opening being disposed adjacent a respective one of said landings to provide access from said one sub-compartment to one of said holds.

2. A cargo ship as set forth in claim 1 which further comprises a second flight of steps in the other of said sub-compartments, said second flight having vertically spaced apart landings at intermediate levels thereof; and a second row of access openings in the other of said transversely extending bulkheads, each said opening being disposed adjacent a respective one of said landings of said second flight to provide access from said other sub-compartment to the other of said holds.

3. A cargo ship as set forth in claim 2 which further comprises a pair of longitudinally extending bulkheads disposed in parallel to and on opposite sides of said longitudinally extending bulkhead to define a pair of access passages, each said access passage having a respective flight of steps therein.

4. A cargo ship as set forth in claim 3 which further comprises a pair of hatches, each said hatch communicating with an upper end of a respective access passage.

* * * * *